US010488133B1

(12) United States Patent
Karczwski

(10) Patent No.: US 10,488,133 B1
(45) Date of Patent: Nov. 26, 2019

(54) QUICK RELEASE GUN LOCK

(71) Applicant: Sean Karczwski, Manhatten, IL (US)

(72) Inventor: Sean Karczwski, Manhatten, IL (US)

( * ) Notice: Subject to any disclaimer, the term of this patent is extended or adjusted under 35 U.S.C. 154(b) by 0 days.

(21) Appl. No.: 16/018,429

(22) Filed: Jun. 26, 2018

(51) Int. Cl.
*F41A 17/54* (2006.01)
*F41A 17/06* (2006.01)

(52) U.S. Cl.
CPC ..... *F41A 17/54* (2013.01); *F41A 17/06* (2013.01)

(58) Field of Classification Search
CPC ..... F41A 17/54
See application file for complete search history.

(56) References Cited

U.S. PATENT DOCUMENTS 5,417,000 A * 5/1995 Chen ..... F41A 17/02 42/70.06
5,621,996 A * 4/1997 Mowl, Jr. ..... F41A 23/18 211/64
6,438,885 B1 * 8/2002 Murray ..... F41A 17/54 211/64
6,845,640 B2 * 1/2005 Loeff ..... E05B 53/003 109/45
7,658,028 B2 * 2/2010 Pintar ..... F41A 17/02 42/70.06
9,010,007 B2 * 4/2015 Chandler ..... F41A 17/04 206/315.11
9,534,867 B2 * 1/2017 Dunn ..... F41C 33/06
9,677,835 B1 * 6/2017 Binns ..... F41A 17/54
2018/0356172 A1 * 12/2018 Mack ..... F41A 17/54

OTHER PUBLICATIONS

Jeremy S., "Gear Review: ARmA15 AR-15 Quick Wall Mount", https://www.thetruthaboutguns.com/gear-review-arma15-ar-15-wall-mount, (Year: 2015).*
ShotLock, "ShotLock : AR Solo-Vault", https://www.youtube.com/watch?v=uF2R3Oz3aUI, (Year: 2014).*

* cited by examiner

*Primary Examiner* — Joshua T Semick
(74) *Attorney, Agent, or Firm* — Applied Patent Services, PC; James D Palmatier

(57) ABSTRACT

The one hand operable quick release gun lock comprises a clam-shell configured hinged case surroundingly on an AR style gun having a magazine port flange. A flange engagement on each of the first and second sides bears against the magazine port lip. The gun is sandwiched between the first and second sides. A locking mechanism comprises an electrically actuated actuator on the first side having a rotatable shaft with a pointed end and a flat formed on the shaft adjacent the pointed end. An anchor on the second side comprises a hasp slidably mounted on the second side, the hasp bearing against the flat whereby the shaft is attached to the flat. Rotation of the shaft urges the hasp away from the flat disconnecting the two part lock. The hinge spring urges the gun lock off the gun in a direction away from the shooter.

16 Claims, 5 Drawing Sheets

QUICK RELEASE GUN LOCK

FIELD OF THE INVENTION

The present invention relates generally to safety mechanisms for use on firearms such as AR-style rifles.

BACKGROUND OF THE INVENTION

External gun safety mechanisms have been used in the prior art to prevent an unintentional discharge. A firearm typically comprises a barrel, receiver, trigger/hammer mechanism and grip or stock. Prior art safety devices include devices that fit over or on a trigger guard, surrounding the trigger or engaging the firing mechanism to prevent accidental discharge.

Gun owners want to secure their guns while still being able to access the gun quickly. Prior art external gun securing devices require the shooter to unlock and remove the device from the gun. Therefore, a quick release gun lock operable by one hand in the shooting position is needed that can be easily and quickly removed.

BRIEF DESCRIPTION OF THE PRESENT INVENTION

The quick release gun lock comprises a spring loaded clam-shell configuration. A shooter may close the quick release lock onto a gun with one hand. The shooter may remove the quick release gun lock with one hand while holding the gun in a ready position. The quick release gun lock adapted to fall away from the shooter. The quick release lock may have a first side and a second side. The first side and the second side are attached by a hinge in a clam-shell configuration. For illustration purposes the first side may be a trigger side and the second side a cheek side for use on a gun. The gun may be a rifle having a barrel, receiver, stock and trigger mechanism. The receiver comprising a top and a bottom. A magazine port formed in the bottom of the receiver, the magazine port having a generally rectangular opening surrounded by a outwardly flanged magazine port flange. The trigger mechanism having a trigger and generally a trigger guard on the receiver partially surrounding the trigger.

The first side of the quick release gun lock having an outside, an inside, a hinge end and a stock end. The inside comprising a first lock portion and a first magazine port engagement extending inward. The first hinge end may be connected to the spring loaded hinge. The second side of the quick release gun lock having an outside, an inside, a hinge end and a stock end. The second hinge end connected to the spring loaded hinge. The second inside comprising a second lock portion and a second magazine port engagement extending inward. Each of the first and second magazine port engagements may be a channel having a first flange spaced from a second flange, the magazine port flange disposed between the first flange and the second flange. Alternately, the first and second magazine port engagements may be a flange wall protruding from the first and second inside respectively, the flange wall bearing against the magazine port flange.

The quick release gun lock may be a clam-shell configuration whereby the first side and second side may move from an open position to a closed position about spring loaded hinge. In the closed position, the gun may be sandwiched between the first inside and the second inside. Magazine port engagements on the inside of each of the first and second side engage and bear against the magazine port flange. The first lock portion is attached to the second lock portion whereby the quick release gun lock is releasably attached to the gun in a spring compressed, closed position.

In the open position, the one hand operated quick release gun lock is adapted to receive the gun between the first side and the second side. The quick release gun lock may be closed about the gun and locked in this closed position having the gun sandwiched between the first side and the second side. The quick release gun lock retains the gun by the first and second magazine port engagement bearing against the magazine port flange. The spring loaded hinge may be disposed in front of the magazine port having the magazine port between the hinge and the trigger.

A locking mechanism having a first portion on the first side and a second portion on the second side may extend through the trigger guard to engage and hold the quick release gun lock in the closed position about the gun. Circuitry including an actuator, a shooter interface and memory are attached to the locking mechanism to recognize an open lock command and energize the actuator to urge the first locking portion to release from the second locking portion. Proper engagement with the shooter interface causes the locking mechanism to release. The shooter interface may be adapted to receive input related to a numeric code, bio-metric information, voice command or predefined pattern of keys to actuate the first lock portion to release from the second lock portion. Upon release the spring loaded hinge moves the first side and second side to an open configuration. The energy from the spring loaded hinge causes the quick release lock to project away from the shooter.

The locking mechanism may further comprise a rotating shaft portion and a hasp portion. The shaft portion may be an electric motor drive assembly controlled by the operator interface. The rotatable shaft comprises a pointed tip, a tapered portion a slot adjacent the taper portion and may extend generally perpendicular to the first side. The shaft rotates from a locking position to a unlocked position. The rest position is locking position. The drive assembly is powered by a battery or other power source.

The hasp portion may be a sliding, spring loaded hasp on the second side and adapted to engage the rotatable shaft. As the first side is rotated about the hinge to the closed position, the shaft engages the hasp to displace the hasp. The hasp slides on shaft tapered portion. The shaft traverses to receive the hasp in the slot whereby shaft is attached to hasp. The hasp may be urged out of the slot by rotating the shaft ¼ turn or more or lifting the hasp out of the slot. The spring loaded hasp in the slot holds the first and second side in the closed position.

The quick release gun lock may be attached to the gun with one hand. The gun may be released from the quick release gun lock with one hand upon proper engagement with the shooter interface. The shooter interface may be one or more input devices such as key pad, key lock, touch pad, bio-metric sensor, voice or other mechanism to take a signal from the shooter to release from the rifle. The quick release gun lock falls using momentum created by the two sides moving to the open configuration to urge the quick release gun lock away from the trigger guard, toward the barrel. The locking mechanism may automatically return to a locking configuration.

The above description sets forth, rather broadly, the more important features of the present invention so that the detailed description of the preferred embodiment that follows may be better understood and contributions of the present invention to the art may be better appreciated. There are, of course, additional features of the invention that will be described below and will form the subject matter of claims. In this respect, before explaining at least one preferred embodiment of the invention in detail, it is to be understood that the invention is not limited in its application to the details of the construction and to the arrangement of the components set forth in the following description or as illustrated in the drawings. The invention is capable of other embodiments and of being practiced and carried out in various ways. Also, it is to be understood that the phraseology and terminology employed herein are for the purpose of description and should not be regarded as limiting.

DETAILED DESCRIPTION OF THE INVENTION

Figure 1:
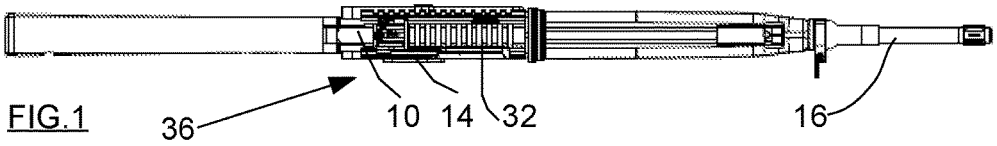
FIG. 1 is a top plan view of the quick release gun lock in a closed position, on a rifle.
Figure 2:
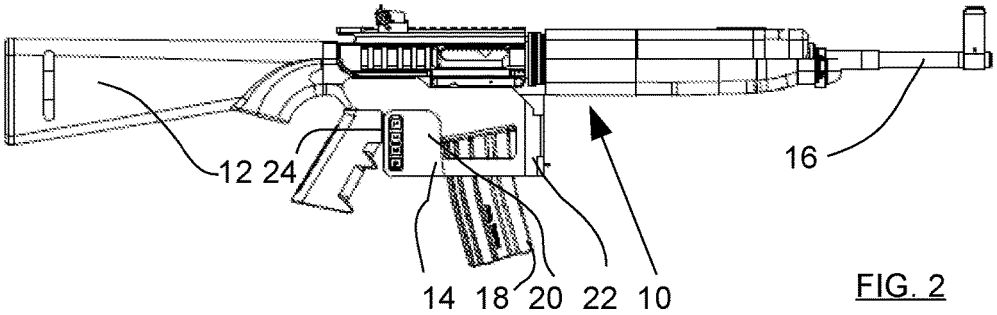
FIG. 2 is a first side elevation view of the quick release gun lock in a closed position, on a rifle
Figure 4:
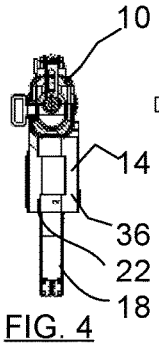
FIG. 4 is a front elevation view of the quick release gun lock in a closed position, on a rifle.
Figure 3:
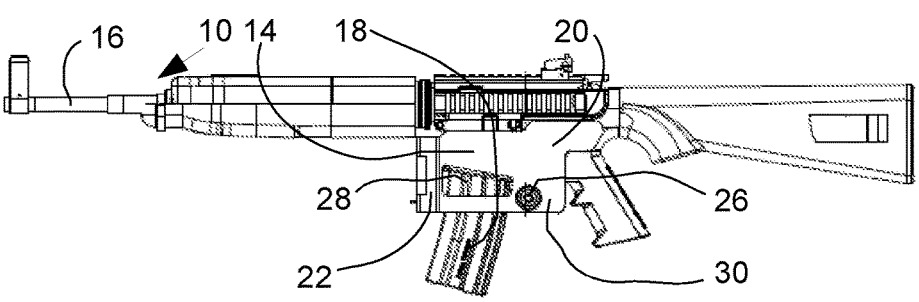
FIG. 3 is a second side elevation view of the quick release lock gun in a closed position, on a rifle.
Figure 5:
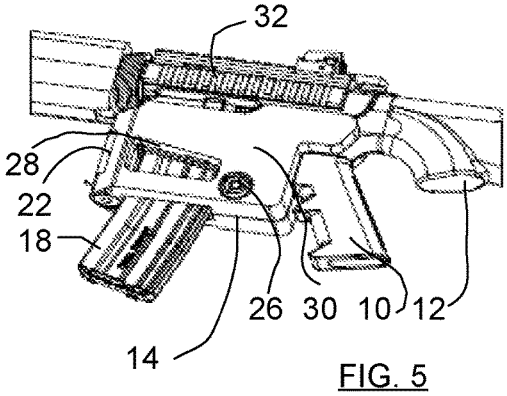
FIG. 5 is a bottom second side perspective view of the quick release gun lock in a closed position, on a rifle
Figure 6:
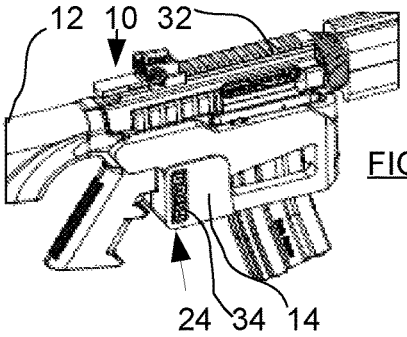
FIG. 6 is a top first side perspective view of the quick release gun lock in a closed position, on a rifle
Figure 7:
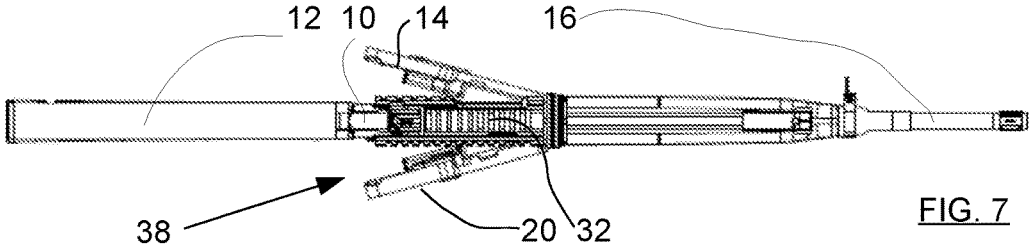
FIG. 7 is a top plan view of the quick release gun lock in an open position, on a rifle.

In the following detailed description of the preferred embodiments, reference is made to the accompanying drawings, which form a part of this application. The drawings show, by way of illustration, specific embodiments in which the invention may be practiced. It is to be understood that other embodiments may be utilized and structural changes may be made without departing from the scope of the present invention. It is to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting. It should be appreciated that the invention can be used for any suitable.

Referring to FIGS. 1 to 7, the quick release gun lock 14 may be attached to a gun 10. The gun 10 may comprise a stock 12, a barrel 16 and a magazine 18. The quick release gun lock 14 may comprise a first side 20, a hinge 22, a shooter interface 24, a lock 26 and a viewing port 28. The first side 20 is attached to the hinge 22. The shooter interface 24 may be on the first side 20. Shooter interface 24 may be connected to battery 25, circuitry 27, memory 29 and actuator 50. Memory 29 may save patterns or data to be compared to input from the shooter interface 24 to energize circuitry 27 to actuate actuator 50.

Continuing to refer to FIGS. 1 to 7, the quick release gun lock 14 may further comprise a second side 30. The second side 30 on the hinge 22 whereby the hinge 22 urges the first side 20 and second side 30 into an open position 38. The gun 10 may further comprise a receiver 32 between the stock 12 and the barrel 26. The quick release gun lock 14 may be removably attached about the receiver 32 having the hinge 22 between the magazine 18 and the barrel 16. The shooter interface 26 may be a bio-metric sensor, touch pad or keypad mounted on the first side 20. Quick release gun lock 14 may be adjusted to a closed position 36 having the first side 20 and the second side 30 substantially parallel. A key lock 26 may be on the second side 30.

Figure 8:
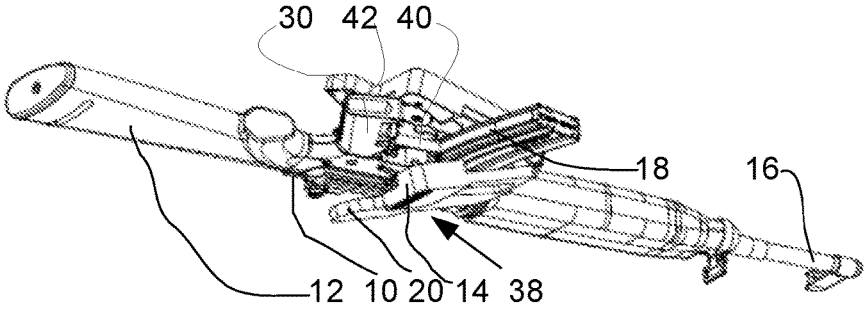
FIG. 8 is a bottom perspective view of the gun lock in an open position, on a rifle.

Referring to FIG. 8, the quick release gun lock 14 may be adjusted to an open position 38 whereby the spring loaded hinge 22 urges the first side 20 and the second side 30 to move to an open position 38. The quick release gun lock 14 may be on the gun 10 where it will fall away from the trigger.

Figure 9:
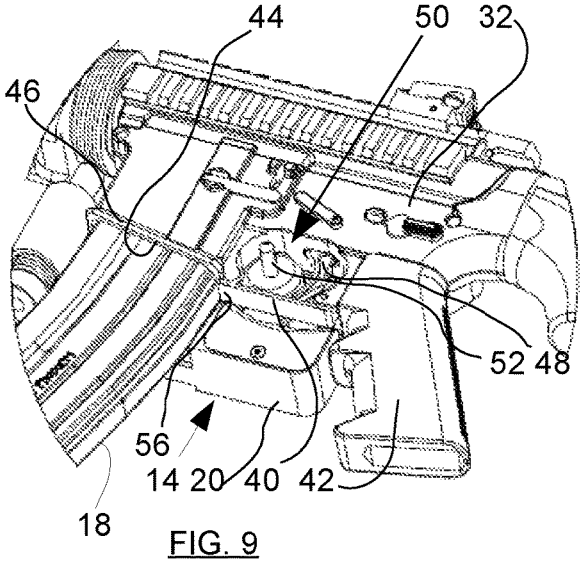
FIG. 9 is a bottom perspective view gun lock in a closed position, on a rifle having the second side removed.

Referring to FIG. 9, the gun 10 may further comprise a trigger guard 40, a pistol grip 42, a magazine port 44 and a trigger 48. Trigger 48 may extend from receiver 32. Trigger guard 40 may be on receiver 32 surrounding the trigger 48 adjacent magazine port 44. magazine 18 is disposed in magazine port 44. Magazine port flange 46 surrounds a portion of magazine port 44. Magazine port flange is on the receiver 32. Quick release gun lock 14 comprises magazine port flange engagement 46 on first side 20 bearing against magazine port flange 46. An actuator 50 on the first side 20.

Figure 10:
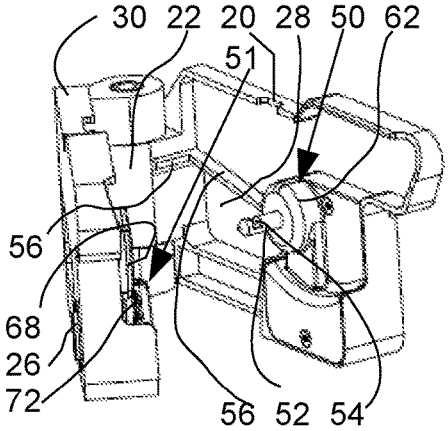
FIG. 10 is a perspective view the quick release gun lock in an open position showing the inside of the first side and the locking mechanism.

Referring to FIGS. 9 and 10, quick release gun lock 14 may be in the open position 38 whereby spring loaded hinge 22 urges the first side 20 apart from the second side 30. Actuator 50 is adapted to releasably attach to an anchor 51 on second side 30. Actuator 50 may be a rotatable shaft 52 having a slot 54. Anchor 51 may engage slot 54 to attach actuator 50 to anchor 51. Lock actuator 50 may extend through trigger guard 40 adjacent trigger 48.

Figure 11:
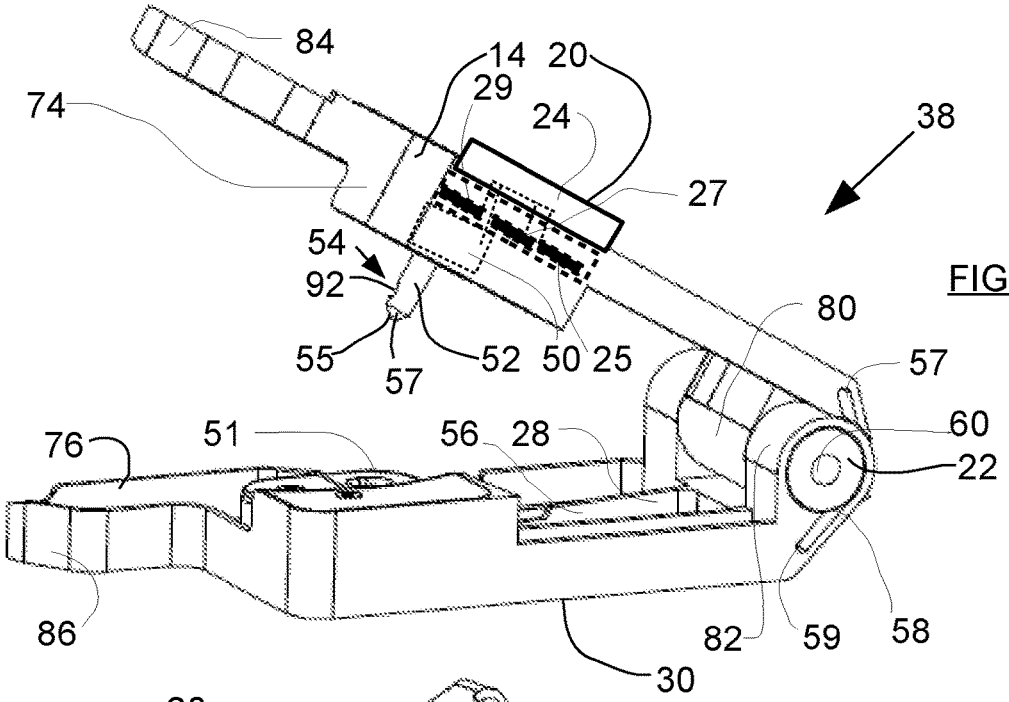
FIG. 11 is a perspective view the quick release gun lock in an open position.

Referring to FIG. 11, quick release gun lock 14 may further comprise a hinge spring 58 disposed around hinge pin 60. First side 20 may be adapted to engage hinge pin 60. Likewise second side 30 may be adapted to engage hinge pin 60 whereby hinge spring 58 bears against first side 20 and second side 30 to urge the first side and second side 30 to move sides 20, 30 to the open position 38. Actuator 50 may be mounted on first side 20 and adapted to engage anchor 51 on second side 30. Rotatable shaft 52 extending generally perpendicular from inside surface of first side 20, between first side 20 and second side 30. Quick release gun lock 14 may further comprise first receiver cover 74 on first side 20 and second receiver cover 76 on second side 30.

Figure 12:
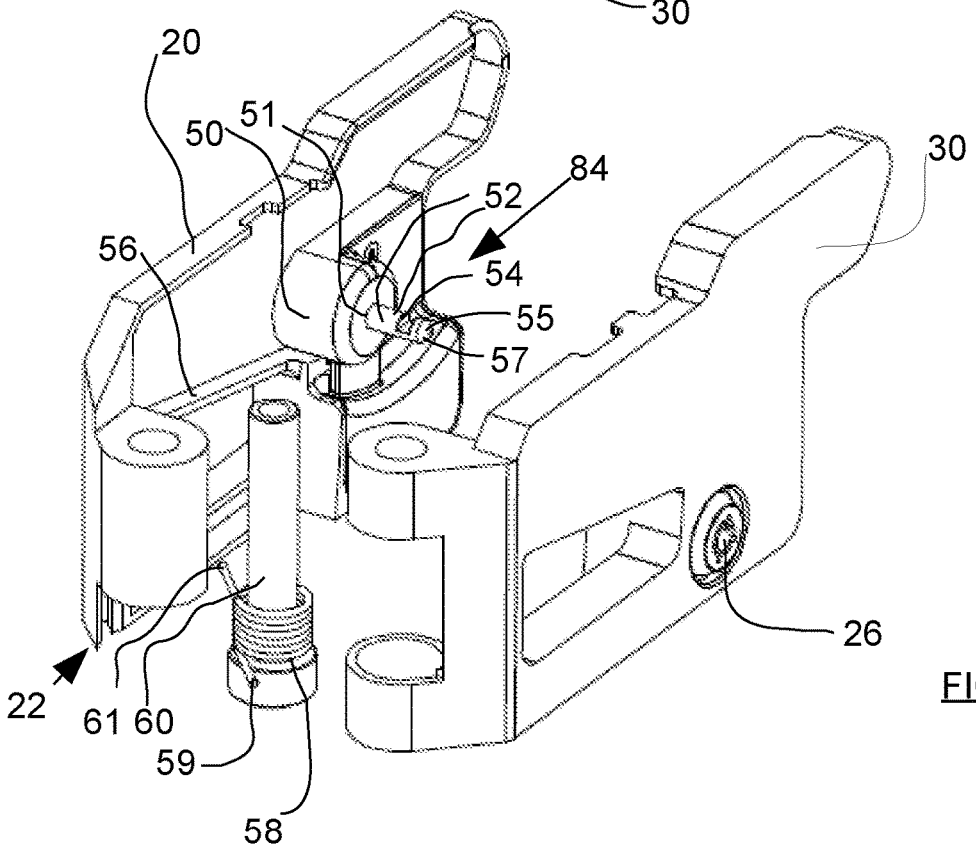
FIG. 12 is an exploded view of the quick release gun lock.

Referring to FIG. 12, hinge pin 60 is rotatably attached to first side 20 and second side 30. Hinge spring 58 may have first end 61 bearing against first side 20 and second end 59 bearing against second side 30. Hinge spring 58 is surroundingly on hinge pin 60. Key lock 26 may be disposed on second side 30. Actuator 50 is attached to shaft 52 at shaft first end 51. Actuator 50 may hold flat 54 in a upward facing locking configuration 84. Shaft 52 may have a pointed end 55 having a tapered portion 57 to engage second side 30. Magazine flange engagement 56 extends inward from first side adjacent hinge 22.

Figure 13:
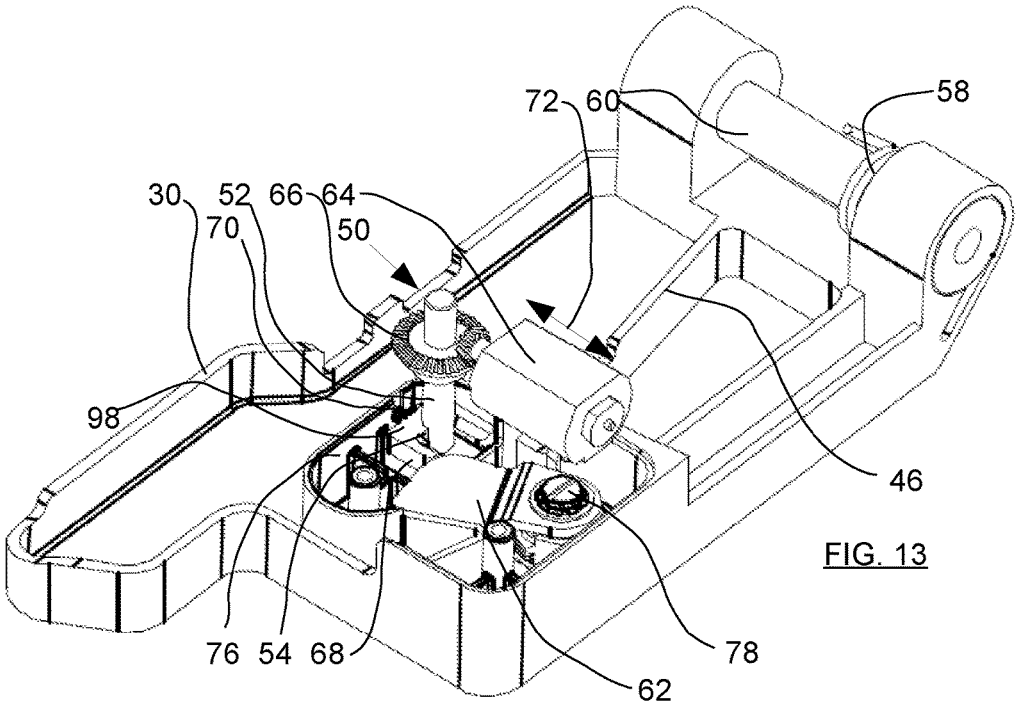
FIG. 13 is a top perspective view of the inside of the first side of the quick release gun lock.
Figure 14:
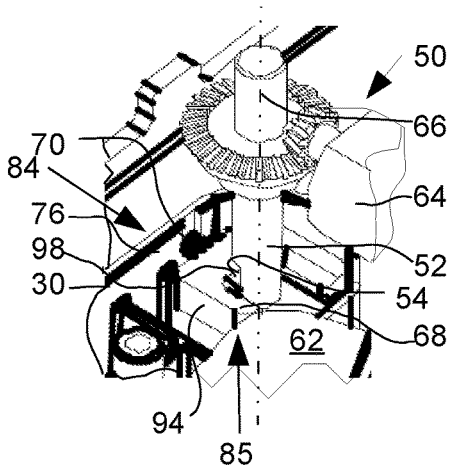
FIG. 14 is a section view of the quick release gun lock taken at approximately 14-14 of FIG. 3.

Referring to FIGS. 13 and 14, actuator 50 may comprise a gear arrangement 62 on shaft 52. The gear arrangement 62 driven by motor 64 whereby shaft 52 rotates along an axis 66 to orient flat 54 in a locking position or unlocking position. Circuitry 75 attached to actuator 50 and shooter interface 26 may be powered by battery or other power source. Circuitry 75 adapted to identify a predetermined input such as a keypad code or fingerprint. Upon recognition of a proper command, the circuitry 75 may actuate the motor 64 to rotate shaft 52.

Continuing to refer to FIGS. 13 and 14, Hasp 68 may be on second side 30 having hasp spring 70 disposed between hasp 68 and hasp wall 76. The hasp 68 is slidably attached to inside of second side 30. Hasp 68 may travel in a generally linear motion indicated by arrow 72. Hasp spring 76 bears against hasp 68 to urge hasp 68 in a locking position 85. In locking position 85, hasp 78 is urged away from hasp wall 76. Hasp 68 is urged into slot 54. At closed shaft position 84, shaft 52 may be rotated by gear arrangement 62 to dispose slot 54 to receive hasp 68. Lock 26 may comprise key port 80 adapted to turn lock shaft 78 to engage hasp 68 with lock tab 62. Lock tab 78 may urge hasp 68 out of slot 54. Actuator 50 may be a rotatable shaft 52 movable to a locking rotation position 84. Actuator 50 may also comprise a motor/gear assembly 62 attached to and rotating shaft 52. The shaft 52 extending generally perpendicular to first side 20. The shaft 52 having a slot 54 configured as a flat 92 spaced from the pointed end 57. The lip engagement 46 may be configured as a flange channel 56 disposed on the first inside 20 between the actuator 50 and the hinge 22. Shaft 52 extending generally perpendicular to second side 20 may be in a locking position at rest having flat 92 rotationally oriented to a predetermined position.

Figure 15A:
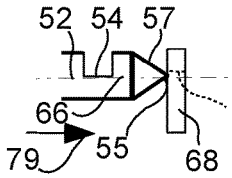
FIG. 15*a* is a side elevation of the rotatable shaft aligned with the spring loaded hasp.
Figure 15B:
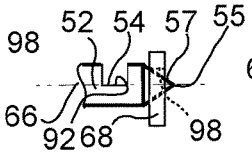
FIG. 15*b* is a side elevation of the hasp sliding on the rotatable shaft.
Figure 15C:
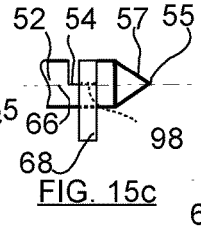
FIG. 15*c* is a side elevation of the hasp in the slot of the rotatable shaft.
Figure 15D:
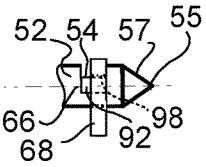
FIG. 15*d* is a side elevation of the rotatable shaft rotated to displace the hasp.
Figure 15E:
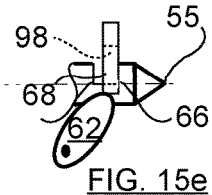
FIG. 15*e* is a side elevation of the key lock bearing against the spring loaded hasp.

Referring to FIGS. 15*a*-15*e*, shaft 52 is disposed having center line 78 under hasp bar 98 (FIG. 15*a*). Shaft 52 traverses generally in the direction of arrow 79 illustrated as left to right in the FIGS. 15*a*-15*e*, toward hasp 68. Hasp bar 98 bears against and slides along taper 57 thereby moving hasp bar 98 in a direction away from axis 66 (FIG. 15*b*). Hasp bar 98 may engage shaft 52 at slot 54. (FIG. 15*c*). Hasp bar 98 is urged out of slot 54 by rotation of shaft 52. (FIG. 15*d*). Lock tab 62 may urge hasp bar 98 out of slot 54 (FIG. 15*e*).

Figure 16A:
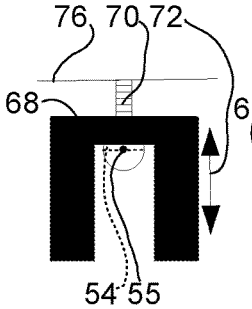
FIG. 16*a* is a front elevation of the rotatable shaft aligned with the spring loaded hasp.
Figure 16B:
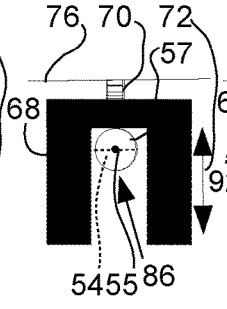
FIG. 16*b* is a front elevation of the hasp sliding on the rotatable shaft.
Figure 16C:
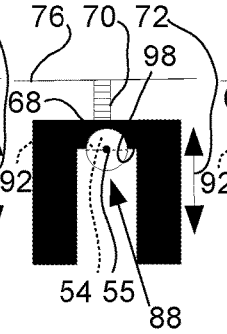
FIG. 16*c* is a front elevation of the hasp in the slot of the rotatable shaft.
Figure 16D:
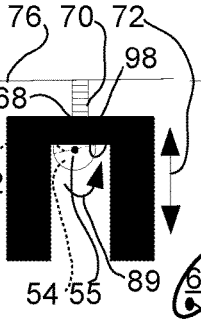
FIG. 16*d* is a front elevation of the rotatable shaft rotated to displace the hasp.
Figure 16E:
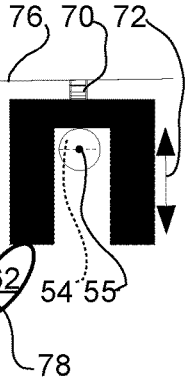
FIG. 16*e* is a front elevation of the key lock bearing against the spring loaded hasp.
Figure 17A:
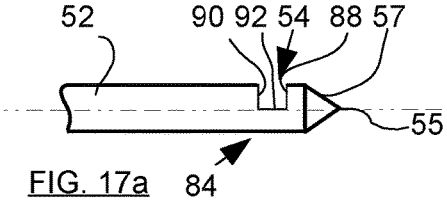
FIG. 17*a* is a side elevation of the rotatable shaft in the locking position.
Figure 17B:
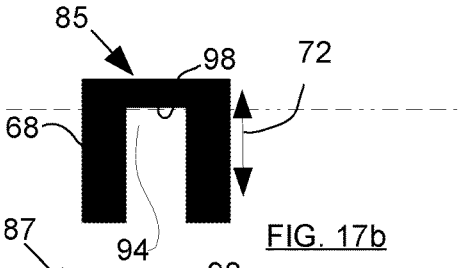
FIG. 17*b* is a side elevation of the rotatable shaft in the unlocking position.
Figure 17C:
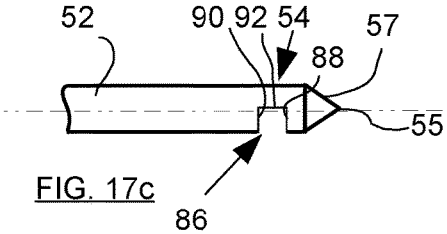
FIG. 17*c* is a front elevation of the hasp in the locking position.
Figure 17D:
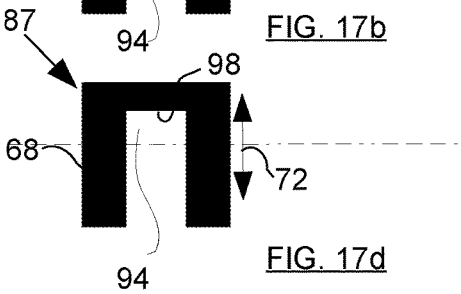
FIG. 17*d* is a front elevation of the hasp in the unlocking position.

Referring to FIGS. 16A-e, hasp 60 and shaft 52 attach by hasp 68 urged into slot 54 by hasp spring 70. Pointed end 55 is disposed to align with hasp opening 94, thereby off set from hasp surface 98. (FIG. 16*a*). As shaft 52 in locking position 84 traverses hasp bar 98 engages taper 57, sliding along taper 57, thereby compressing hasp spring 70 and moving hasp bar 98 in a direction away from axis 66. (FIG. 16*b*) Hasp spring 70 urges hasp 68 into slot 54 having hasp bar 98 bearing against flat 92 attaching hasp 68 to shaft 52. (FIG. 16*c*). Rotation of shaft 52 generally in the direction of arrow 89, urges hasp bar 98 out of slot 54 (FIG. 16*d*). Lock tab 62 may bear against hasp 68 to traverse hasp 68 out of slot 54 thereby disengaging hasp 68 form shaft 52. (FIG. 16*e*)

Referring to FIGS. 17 *a-d*, Slot 54 comprises flat 92, leading edge 88 and trailing edge 90. shaft 52 may be oriented in a locking position 84 having slot 54 opening to receive hasp 68. Hasp 68 may be in locking position 85 having hasp bar 98 urged to a position adjacent axis 66. Shaft 52 may be rotated into a unlocking rotation orientation having the slot 54 oriented away from hasp bat 98. Hasp 68 may be disposed in an unlocking position 87 having locking bar 98 held in a spaced relation to slot 54.

Although the description above contains many specifications, these should not be construed as limiting the scope of the invention but as merely providing illustrations of some of the embodiments of this invention. Thus, the scope of the invention should be determined by the appended claims and their legal equivalents rather than by the examples given. Further, the present invention has been shown and described with reference to the foregoing exemplary embodiments. It is to be understood, however, that other forms, details, and embodiments may be made without departing from the spirit and scope of the invention which is defined in the following claims.

I claim:

1. A quick release gun lock for use with a gun, the gun having a receiver a removable magazine, a trigger and a barrel, the receiver having a magazine port and a trigger, a magazine port flange surrounding the magazine port, a trigger guard on the gun adjacent the trigger, the quick release gun lock comprising:

a first side, a second side and a spring loaded hinge, the first side comprising a first inside, a first outside and a first spring end, the first spring end attached to the spring loaded hinge, the second side comprising a second inside, a second outside and a second spring end, the second spring end attached to the spring loaded hinge;

a magazine port flange engagement, the magazine port flange engagement comprising a first flange engagement on the first inside, the first flange engagement adapted to bear against the magazine port flange; and a locking mechanism comprising a first side portion and a second side portion, the first side portion on the first inside, the second side portion on the second inside, the first side portion releasably attached to the second side portion, the locking mechanism adapted to extend through the trigger guard wherein the magazine port flange engagement is disposed between the locking mechanism and the spring loaded hinge.

2. The quick release gun lock of claim 1, further comprising a second flange engagement on the second side, the second flange engagement bearing against the magazine port flange, the first flange engagement and the second flange engagement forming a magazine opening, the magazine opening between the spring loaded hinge and the locking mechanism.

3. The quick release gun lock of claim 1, the first side portion further comprising a viewing port and an actuator on the first side, the viewing port between the spring loaded hinge and the locking mechanism, the second side portion comprising an anchor on the second side.

4. The quick release gun lock of claim 3, wherein the actuator further comprises a motor, a gear mechanism and a rotatable shaft, the motor on the first side, the gear mechanism on the motor, the rotatable shaft on the gear mechanism, the rotatable shaft extending approximately perpendicular to the first inside, the rotatable shaft attached to the anchor.

5. The quick release gun lock of claim 3, further comprising a shooter interface, the shooter interface comprising an input device, the shooter interface connected to the actuator, the magazine port flange engagement disposed between the spring loaded hinge and the shooter interface whereby the quick release gun lock may be operated with one hand.

6. The quick release gun lock of claim 5, wherein the shooter interface is a bio-metric sensor.

7. The quick release gun lock of claim 2, further comprising a magazine opening between the first flange engagement and the second flange engagement, the first flange engagement further comprising a protrusion extending from the first inside, the second flange engagement further comprising a protrusion on the second inside, the magazine opening between the first inside and the second inside.

8. The quick release gun lock of claim 1, the first flange engagement further comprising a channel extending from first inside, the magazine port flange in the channel.

9. The quick release gun lock of claim 6, further comprising a key actuated shaft having a lock tab thereon, the lock tab movable to release the first lock portion from the second lock portion.

10. The quick release gun lock of claim 4, wherein the anchor further comprises a slidable hasp on the second inside, the slidable hasp comprising a hasp spring and a hasp bar, the rotatable shaft further comprising a first end, a pointed end and a slot, the first end on the gear mechanism, the pointed end spaced from the first inside, the slot between the first end and the pointed end, the hasp bar in the slot.

11. A quick release gun lock releasably attached to a gun, the gun comprising a receiver having a trigger, a magazine port and a magazine port flange, the magazine port flange on the receiver surrounding the magazine port, the quick release gun lock comprising:

a first side, the first side bearing against the magazine port, a first flange engagement on the first side, the first flange engagement bearing against the magazine port flange;

a second side, the second side bearing against the magazine port, a second flange engagement on the second side, the second flange engagement bearing against the magazine port flange;

a hinge comprising a hinge pin and a hinge spring, the hinge spring on the hinge pin, the hinge in on the first side, the hinge pin on the second side, the hinge spring having a first end and a second end, the first end bearing against the first side, the second end bearing against the second side; and a locking mechanism, the locking mechanism comprising an actuator and an anchor, the actuator on the first side, the actuator is a rotatable shaft having a first end, a tapered end and a flat, the tapered end spaced from the first side, the flat on the shaft adjacent the tapered end, the anchor further comprises a hasp slidably attached to the second side, the hasp adapted to releasably engage the shaft, the anchor on the second side, the actuator attached to the anchor.

12. The quick release gun lock of claim 11, further comprising a shooter interface, the shooter interface connected to the actuator, the shooter interface comprising an input device chosen from the configurations of a touch pad, a bio-metric sensor, a key actuated lock and a key pad.

13. The quick release gun lock of claim 11, wherein the actuator further comprises a motor attached to the rotatable shaft, the motor connected to the shooter interface.

14. The quick release gun lock of claim 13, wherein the hasp further comprises a hasp spring on the second side, the hasp spring urging the hasp into the flat.

15. The quick release gun lock of claim 14, further comprising a key lock on the second side, the key lock having a rotatable shaft and a lock tab, the lock tab on the rotatable shaft, the lock tab adapted to engage the hasp to urge the hasp out of the flat.

16. A quick release gun lock on a gun, the gun having receiver and a trigger guard, a magazine port flange on the receiver, the quick release gun lock comprising:

a first side having a first inside, a second outside, an actuator, a first magazine port flange engagement and a hinge attachment, the actuator on the first inside, the actuator comprising a motor and a rotatable shaft, the motor attached to the first inside, the rotatable shaft having a first end, a pointed end and a flat, the first end on the motor, the pointed end spaced from the motor, the flat formed on the rotatable shaft adjacent the pointed end, the first magazine port flange engagement bearing against the magazine port flange;

a second side having a second inside, a second outside, an anchor, a second magazine port flange engagement and a hinge attachment, the anchor on the second inside, the anchor comprising a hasp, the hasp slidably on the second side, the hasp bearing against the flat, the second magazine port flange engagement bearing against the magazine port flange;

a shooter interface on the first outside, the shooter interface connected to the motor; and a key lock on the second outside, the key lock comprising a key lock shaft and a key lock tab, the key lock tab on the key lock shaft, the key lock shaft generally perpendicular to second inside, the key lock shaft spaced from the hasp, the key lock tab bearing against the hasp.

* * * * *